United States Patent [19]

Timmermeister

[11] Patent Number: 4,693,337

[45] Date of Patent: Sep. 15, 1987

[54] COMPACT CATALYTIC CONVERTER

[75] Inventor: Dieter M. Timmermeister, Waterloo, Canada

[73] Assignee: Tri-D-Automotive Industries, Ltd., Waterloo, Canada

[21] Appl. No.: 812,549

[22] Filed: Dec. 23, 1985

Related U.S. Application Data

[63] Continuation-in-part of Ser. No. 732,311, May 9, 1985, abandoned.

[51] Int. Cl.[4] ..... F01N 3/02

[52] U.S. Cl. ..... 181/231; 181/258; 181/272; 55/276; 55/DIG. 30; 60/299

[58] Field of Search ..... 181/231, 256, 258, 269, 181/272; 60/299; 55/276, DIG. 30

[56] References Cited

U.S. PATENT DOCUMENTS

| | | | |
|---|---|---|---|
| 2,828,189 | 3/1958 | Houdry | 181/258 X |
| 3,024,593 | 3/1962 | Houdry | 60/299 |
| 3,100,140 | 8/1963 | Ashley et al. | 181/268 X |
| 3,852,041 | 12/1974 | Moore et al. | 60/299 X |

*Primary Examiner*—Benjamin R. Fuller

[57] ABSTRACT

A catalytic converter has a gas pervious catalyst support member extending across a housing and dividing the housing into an upper chamber and a lower chamber. The catalyst support member has two parallel spaced apart upper and lower foraminous sheets which undulate across the width of the container and each having a single peak and a single trough to form a catalyst containing chamber between the two sheets having a generally sinusoidal-type wave configuration when viewed in cross-section along a plane perpendicular to the length of the housing. A bed of catalyst particles substantially fills the catalyst containing chamber. A gas inlet at one end of the housing is positioned to cause gases to enter into one of the upper and lower chambers and pass through the catalyst support member and the catalyst containing chamber to the other of the upper and lower chambers, with a gas outlet at an opposite end of the housing being positioned to cause the gases to leave from the other chamber. A combined catalytic converter-muffler may be provided by incorporating one or more muffler tubes in the housing in communication with the inlet and/or outlet.

14 Claims, 10 Drawing Figures

Figure 1:
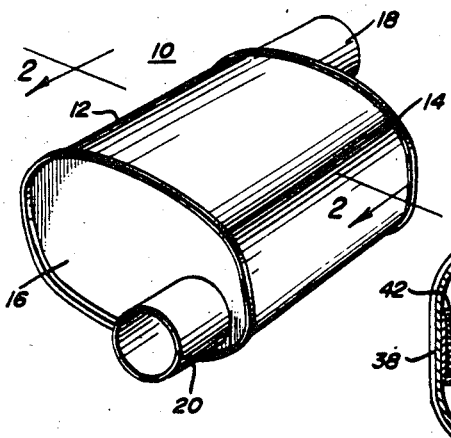

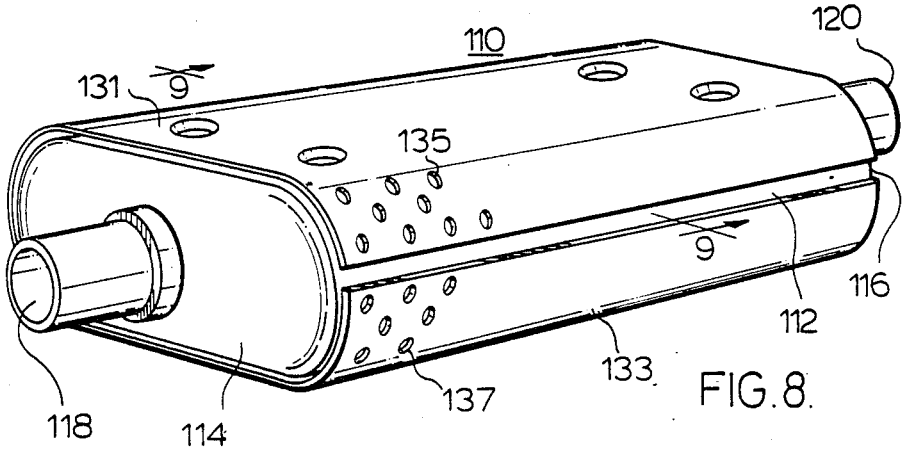
FIG. 8.
FIG. 9.
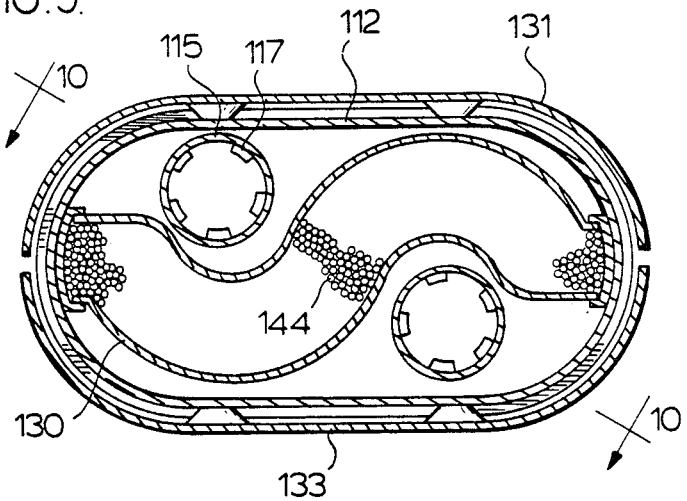

COMPACT CATALYTIC CONVERTER

This application is a continuation-in-part of Application 732,311 filed May 9, 1985 now abandoned.

This invention relates to catalytic converters for use in treating exhaust gases.

Catalytic converters using particulate catalysts have been made in various configurations. One type is to have a converter of circular section in which the catalyst particles are maintained in an annular zone with the exhaust gas fed, for example, into the inside of the annulus. The gas flows through the annular catalyst zone and leaves through an outside surrounding chamber to the outlet. Because the maximum diameter of the converter is fixed, typically a distance of 4 inches from top to bottom in the case of a device for use under an automobile body, the maximum diameter of the annulus is limited. With a small maximum diameter there cannot be much material placed in a given cross section of the device and as a result the device must be relatively long.

Another configuration is a relatively flat bed containing particulate catalyst. U.S. Pat. No. 3,024,593 (Houdry) teaches the use of a pair of perforated grids formed of corrugated sheet metal to form a catalyst chamber which is suspended by end plates within a rectangular container. This internal suspension of the catalyst chamber allows for thermal expansion. However, such a device is relatively complicated and difficult to fabricate.

U.S. Pat. No. 3,852,041 (Moore et al) teaches the use of a low profile catalytic converter which has two inverted pans which hold the catalyst particles suspended in the middle of the device. The pans have many openings to permit the exhaust gas to flow through the pan and into the catalyst bed. The two U-shaped pans have outer flanged surfaces which are used to join the two pans together. The amount of catalyst contained in a given cross-section taken across the width is only proportional to the height multiplied by the width. Thus for a given fixed width, the amount of catalyst is only proportional to the height of the catalyst bed. Since the amount of pressure drop permissible controls the height of the bed, it is not possible to add any additional catalyst to this design.

It is therefore an object of the present invention to provide an improved catalytic converter which substantially overcomes the above-mentioned difficulties of prior art converters.

The present invention provides a catalytic converter comprising a housing, a gas pervious catalyst support member extending across the housing and dividing the housing into an upper chamber and a lower chamber, said catalyst support member comprising two parallel spaced apart upper and lower foraminous sheets which undulate across the width of the container and each has single peak and a single trough to form a catalyst containing chamber between the two sheets having a generally sinusoidal-type wave configuration when viewed in cross-section along a plane prependicular to the length of the housing, a bed of catalyst particles substantially filling the catalyst containing chamber, gas inlet means at one end of the housing positioned and pass through the catalyst supoort member and the to cause gases to enter into one of the upper and lower chambers catalyst containing chamber to the other of the upper and lower chambers, and gas outlet means at an opposite end of the housing and positioned to cause the gases to leave from the other chamber.

Such a converter is compact, easy and inexpensive to fabricate, and can contain a relatively high quantity of catalyst.

The sinusoidal-type wave configuration advantageousl has sufficient amplitude such that the peak in the lower foraminous sheet is higher than the trough in the upper foraminous sheet.

The gas pervious catalyst support member may be a replaceable enclosed unit which contains the catalyst particles. The converter may include means to hold the catalyst support member within the housing comprising two U-shaped channels on opposite sides of the housing into which the catalyst support member slidably engages.

The catalyst containing chamber may contain thermally expansive means to compensate for shrinkage of catalyst particles with increasing temperature. The thermally expansive means may comprise vermiculite.

The gas inlet and gas outlet means may comprise pipes, with the height of the catalytic converter housing being approximately twice the diameter of the pipes. The height of the catalytic converter may be about 4 inches.

The two spaced apart foraminous sheets of the gas pervious catalyst support member may have this efficient sinusoidal confiouration such that the volume of contained catalyst is at least 10% greater than if the two sheets were flat and spaced apart the same distance.

The housing may have at least one detachable end wall. The housing may have an outwardly extending flange rim on an end of the housing and an end wall recessively mounted in the housing and extending out of the housing and bending around to the outwardly extending flange rim.

The catalytic converter of the present invention may be modified to provide a combined catalytic converter-muffler. A muffler tube having shaped muffling apertures may extend within the housing along one of the upper and lower chambers in an undulation of the catalyst support member, said muffler tube having its interior in communication with one of the gas inlet and outlet means to cause gases to pass through said shaped muffling apertures as well as through the catalyst support member during passage from the gas inlet means to the gas outlet means.

A first mentioned muffler tube may have its interior connected to the gas inlet means, and a second muffler tube having shaped muffling apertures may extend within the housing along the other of the upper and lower chambers in an undulation of the catalyst support member, said second muffler tube having its interior in communication with the gas outlet means to cause gases to pass throuoh the shaped muffling apertures of the first muffler tube, and through the catalyst support member and then through the shaped muffling apertures of the second muffler tube during passage from the gas inlet means to the gas outlet means.

The catalytic converter may include inlet and outlet vessels extending across the interior of the housing adjacent the gas inlet and outlet means, the catalyst support member extending between the vessels, the gas inlet means comprising a centrally located inlet pipe in communication with an aperture in the inlet vessel and the gas outlet means comprising a centrally located outlet pipe in communication with an aperture in the outlet vessel.

Figure 2:
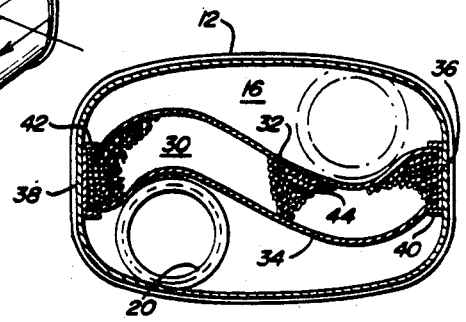
Figure 3:
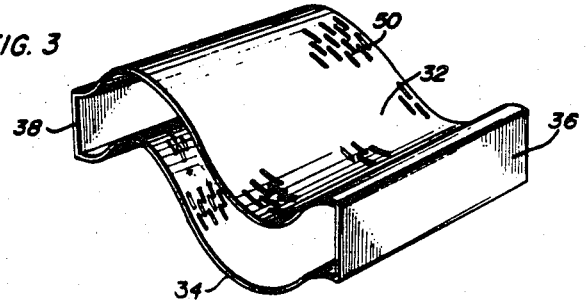
Figure 4:
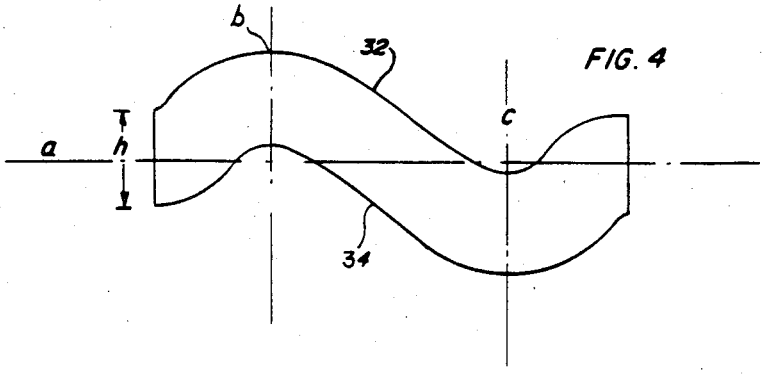
Figure 5:
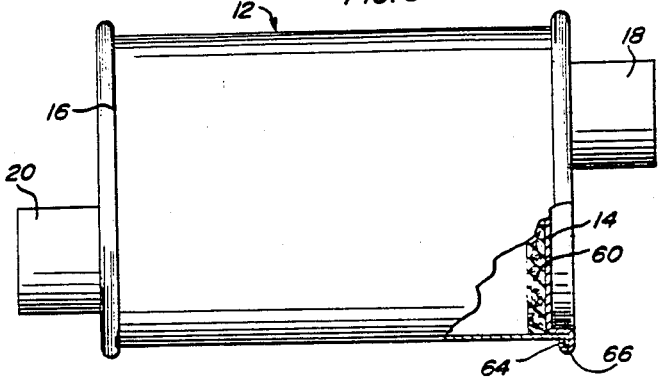
Figure 7:
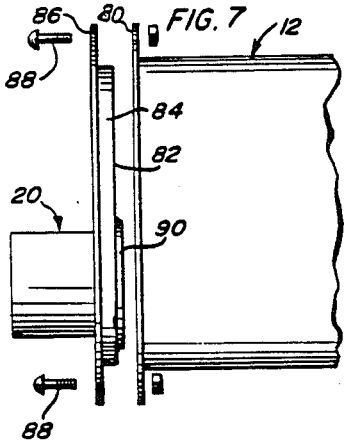
Figure 6:
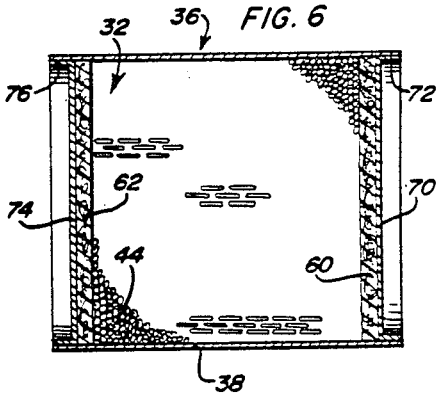
Figure 10:
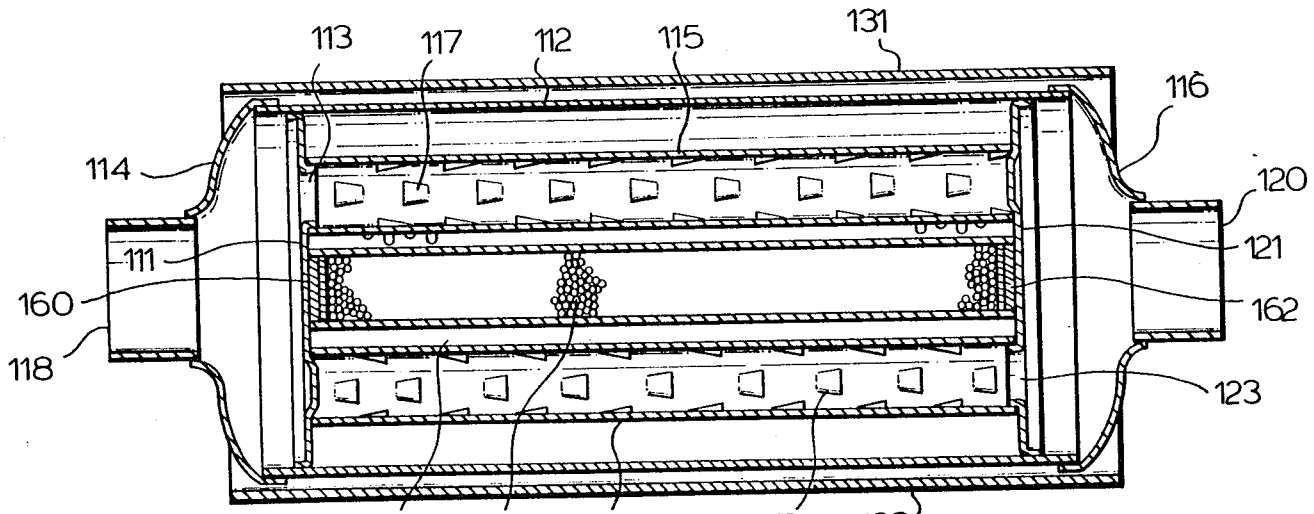

Embodiments of the invention will now be described, by way of example, with reference to the accompanying drawings, of which, FIG. 1 is a perspective view of a catalytic converter in accordance with one embodiment, FIG. 2 is a cross-sectional view taken along line 2—2 of FIG. 1, FIG. 3 is a perspective view of the S-shaped catalytic chamber, FIG. 4 is a schematic view of the two sheets of the S-shaped catalyst support member and the axis of that sinusoidal-type wave, FIG. 5 is a top view of the converter of FIG. 1, FIG. 6 is a top sectional view of a replaceable cartriage used in another embodiment of the invention, FIG. 7 is an exploded partial end view of the replaceable cartriage, FIG. 8 is a perspective view of a combined converter-muffler in accordance with another embodiment, FIG. 9 is a cross-sectional view along the line 8—8 of FIG. 7, and FIG. 10 is a sectional view along line 9 of FIG. 8.

Referring to the drawings, FIG. 1 shows a catalytic converter 1 which has a generally oval-shaped housing 12 having a generally rectangular configuration with rounded edges and end walls 14 and 16 at opposite ends. Because of the symmetrical internal design of the converter, the inlet and outlet can be at either end. For illustration purposes, end 14 will be referred to as having inlet pipe 18 and the opposite end 16 as having an outlet pipe 20.

In FIG. 2, the housing 12 is seen in cross-section with the back wall 16 having outlet 20 therein. Supported in the middle of the central container housing is the S-shaped catalyst support member 30. It is typically made of metal such as stainless steel. It has a top undulating wall 32 and a spaced-apart, generally parallel bottom wall 34. Both the top and bottom walls have many openings 50 as seen in FIG. 3 which permit gases to flow through the walls. In the embodiment illustrated in FIG. 2 the top and bottom are connected together in one continuous sheet by right side wall 36 and left side wall 38. The S-shaped catalyst support member is maintained within the housing 12 by U-shaped channels 40 and 42 which are secured to the inner side walls of the housing and into which each side of the S-shaped member slides. Within the catalyst support chamber are the catalyst particles 44, which are preferally in beaded form.

The preferred overall design of the converter is to have a height which is as short as possible. The device will normally be assembled under the body of an automobile and the amount of space available here is limited. Thus the smaller the height of the unit the better. A further design constraint is that the normal size of the exhaust pipe from the engine is nominally about 2 inches. According to a preferred embodiment of this invention, the oval-shaped converter housing only has a height of about 4 inches and the S-shaped container has a height or thickness of about 1.25 inches. Since there will be a 2 inch inlet pipe on one side of the S-shaped container, a 2 inch outlet pipe on the other side of the S-shaped container and a 1.25 inch thick S-shaped container all fitting inside the 4 inch housing, it is seen that the catalyst container must have a substantial bend or "S-shape" to obtain the desired configuration.

When viewed in cross-section (i.e. across the width of the catalytic converter) a unique feature of the S-shaped catalyst container, as shown in FIG. 2, is that the length of the sheet material forming the upper surface is the same length as the sheet material forming the lower surface. When the device is operated at high temperatures the metal sheets of the S-shaped container are heated from ambient temperature to a much higher operating combustion temperature. Although the metal sheets thermally expand, they will be equally expanding since both of the sheets are the same size. As a result the volume between the two sheets where the catalyst is located remains essentially the same.

FIG. 3 is a perspective view of the S-shaped container in FIG. 2 showing its continuous structure. The continuous sheet is bent into a top wall 32, a side wall 36, a bottom wall 34 and an opposite side wall 38. Perforations 50 are shown throughout the top and bottom sheets to permit the exhaust gases to flow through the catalyst inside the container. Perforations are preferably not made in the two side walls so as to give them greater structural strength.

FIG. 4 illustrates the geometric relationship of the top and bottom walls of the S-shaped catalyst container. The top wall 32 and the bottom wall are spaced apart a distance, h, which is the height between them. An axis, a, is drawn through the center of the catalyst container. The two walls undulate as one views the structure from left to right. At point b, which is the high point of the top wall 32, the lower wall 34 bends up so high as to pass up over the axis a. This extensive bend is utilized so the S-shaped member can pass over the outlet pipe 20. Similarly, further over to the right at position c, where the lower wall 34 is at its lowest point, the upper wall 32 bends down below the axis a. In other words, the peak in the wave shape of the lower wall 34 is higher than the trough in the wave shape of the upper wall 32. This extensive bend permits the S-shaped member to pass under the inlet pipe 18.

The shape of the catalyst support member 30 has been referred to as "S-shaped". In the one wave embodiment shown in FIG. 2, the catalyst support member had to pass up over the outlet pipe 20 and then down under inlet pipe 18. The curve defined by this bending is not strictly a sine wave curve. However it is believed that the term sinusoidal-type is an apropriate description of this up and down motion of the catalyst support member which for brevity is being referred to as the S-shaped support member.

A further advantage of having such an extensive bend in the top and bottom walls of the S-shaped member is the resulting increase in the amount of catalyst volume over what would normally be present if the two walls were just straight and spaced apart the same distance h. By having a sufficient sinusoidal configuration according to the present invention it is possible to preferably have at least a 10% increase in catalyst volume compared to the case where the two sheets were flat and spaced apart the same distance. For example, for a central housing which is only $6\frac{7}{8}$ inches wide it is possible to fit inside an S-shaped chamber having a linear length of 8 inches along the top wall 32. This amounts to a 16.4% increase in catalyst volume compared to a similar flat catalyst bed having essentially the same height and length.

In the top view illustrated in FIG. 5 is a cut away to show the device of FIG. 1 where at each end are thermal expansive elements 60 (shown) and 62 (not shown) within the S-shaped member. These thermal expansive elements cushion the catalyst particles at each end and the thermal expansive elements expand when the temperature in the catalyst chamber rises so that void volumes are not created due to the volume shrinkage of the catalyst upon heating.

The cut away portion of FIG. 5 illustrates how the inlet side end 14 can be preferably attached to housing 12. The ends of housing 12 are bent outward to form a flange rim 64. The end wall 14 has a larger cross-sectional area than the area of the inside of the central container housing 12. The outer edge of the wall 14 is recessed inside the housing 12 and the remainder of the edge portion of the wall 66 is bent out and around the flange rim 64 to provide for a tight seal.

The device shown in FIGS. 1 and 2 can be assembled by first assembling one end such as inlet end 14 to the central housing 12 with the preferred recess setting as shown in FIG. 5. Next, the S-shaped catalyst support member 30, which is one continuous hollow piece, is slid down into the U-shaped channels 40 and 42. A thermally expandable material 60 to be described further, which has been cut to have the same configuration as the S-shaped member, is placed inside the S-shaped member. The catalyst particles 44 are added to almost completely fill up the catalyst support chamber. Next, another S-shaped thermally expansive member 62 is inserted on top of these particles and finally the other outlet side end 16 is inserted and secured in a preferred recess setting in an analogous manner as inlet end 14.

FIGS. 6 and 7 illustrate another embodiment of the invention in which the catalytic converter can be opened and the catalyst support element replaced. FIG. 6 illustrates a sectional top view of the pre-assembled ready to use and replaceable cartriage showing the side walls 70 and 74 of the unit assembled in a recessed position inside the S-shaped catalyst support member. The side walls 70 and 74 have outwardly extending flanges 72 and 76 which can be welded to the four sides 32, 36, 34 and 38 of the S-shaped catalyst support member 30. The replaceable cartriage has the thermally expansive elements 60 and 62 at either end and it is filled with catalyst particles 44.

The replaceable, gas pervious catalyst support container shown in FIG. 6 is made of two parallel spaced apart foraminous sheets of the type shown in FIGS. 2 and 3 as 32 and 34 having a generally rectangular configuration with a length which is generally longer than the width. The perspective view in FIG. 3 focusses on the shape of the container; although it may not actually measure as having a longer length than width, such an embodiment is intended and preferred. The side walls 36 and 38 shown in FIG. 3 join the sides of the two top and bottom sheets along their length with the end walls 70 and 74 shown in FIG. 6 enclosing the ends of the two sheets along their width. As shown in FIG. 3, the top and bottom sheets undulate from side to side and have a generally sinusoidal-type configuration when viewed in cross-section along a plane encompassing the end wall. As described earlier, the sinusoidal-type configuration has sufficient amplitude so that when the wave is at its maximum height the lower foraminous sheet is above the horizontal axis of the sinusoidal wave.

The replaceable gas pervious catalyst containing unit shown in FIG. 6 is thus made of the qas pervious catalyst support container described above, a bed of catalyst particles which substantially fill the container, and thermally expansive elements in the container which are adjacent to each end wall and which separate the end wall from the catalyst particles.

In FIG. 7 the housing 12 has an outer flange 80 at one end for attaching the detachable end wall 82. The end wall 82 is recessed inside the central housing 12. It has an outer flange portion 84 which extends outwardly along the inside of the housing 12 and which at the end of the housing 12 then extends perpendicularly outward as flange 86 so that it will seal against the flange 80. The end wall flange 86 is attached to the housing flange 80 by any type of fastening means such as bolts 88. To replace the S-shaped member, the end wall 82 is taken off by removing the bolts 88, the deactivated catalyst-filled S-shaped catalyst support member 30 having the configuration shown in FIG. 6 is pulled out and replaced with a new catalyst containing S-shaped catalyst support member which slides into the U-shaped channels 40 and 42 on either plane encompassing the end wall. As described earlier, the sinusoidal-type configuration has sufficient amplitude so that when the wave is at its maximum height the lower foraminous sheet is above the horizontal axis of the sinusoidal wave.

The replaceable gas pervious catalyst containing unit shown in FIG. 6 is thus made of the gas pervious catalyst support container described above, a bed of catalyst particles which substantially fill the container, and thermally expansive elements in the container which are adjacent to each end wall and which separate the end wall from the catalyst particles.

In FIG. 7 the housing 12 has an outer flange 80 at one end for attaching the detachable end wall 82. The end wall 82 is recessed inside the central housing 12. It has an outer flange portion 84 which extends outwardly along the inside of the housing 12 and which at the end of the housing 12 then extends perpendicularly outward as flange 86 so that it will seal against the flange 80. The end wall flange 86 is attached to the housing flange 80 by any type of fastening means such as bolts 88. To replace the S-shaped member, the end wall 82 is taken off by removing the bolts 88, the deactivated catalyst-filled S-shaped catalyst support member 30 having the configuration shown in FIG. 6 is pulled out and replaced with a new catalyst containing S-shaped catalyst support member which slides into the U-shaped channels 40 and 42 on either side in the housing. The end wall 82 is put back in place and attached with bolts 88.

FIG. 7 also illustrates a preferred structure for attaching the outlet 20 to the end wall 82. The outlet pipe 20 is inserted through an opening in the end wall 82 and then the inwardly extending end of the pipe 20 is bend outwardly to form a flange 90 which prevents the pipe 20 from being pulled out. This flange 90 can be spot welded to secure the pipe to the wall 82.

The replaceable embodiment shown in FIGS. 6 and 7 is especially adapted to be used for turbine and stationary exhaust emissions where there would be heavy use of the catalyst. In such a heavy use the catalytic units would become deactivated frequently. By employing this replaceable embodiment the deactivated catalytic unit could be quickly replaced with a new fresh unit.

To permit the gas being treated to readily pass through and in contact with the catalyst particles in the S-shaped catalyst support member 30 the top wall 32 and the bottom wall 34 have many openings 50. Although any shape can be used for the opening, a preferred opening configuration is a slot which is approximately 1/16 inch wide (0.062 inch) and ½ inch long. The openings can be positioned either uniformly over the surface or they can be bunched in certain areas to maintain any desired flow pattern.

Although an increase in temperature does not cause the metal catalyst holding chamber to become larger since both the top and bottom walls are expanding equally, there may be a slight decrease in the catalyst volume due to the increased temperature of the catalyst bed. To prevent the catalyst particles from becoming loosely packed and attritting against each other, a thermal expansive material is placed within the S-shaped catalyst chamber preferably at each end against the inside end wall of the converter container or against the end walls of self-contained replaceable catalyst holder unit. The thermally expansive material is a material which can withstand the high temperatures in the converter and which will expand upon being heated. A preferred material is vermiculite. This can be obtained in a pressed form as Interam brand heat reactive material from the 3M Company. The thickness of the material is chosen so that when this material is heated it will thermally expand to approximately the same volume as the catalyst particles shrink. In a preferred embodiment vermiculite strips of about 6 mm. thickness are placed at each end of the S-shaped container. As a result there will not be any significant void opening in the catalyst chamber when the high operational temperatures are reached.

Because the other advantages described above, the invention also enables a very efficient combined converter-muffler to be provided simply by providing one or more muffler tubes within the housing and through wish exhaust gases pass before and/or after passing through the catalytic container. Each muffler tube can be located above or below the catalytic container in one of its anulations with one end of the muffler tube in communication with the inlet or outlet.

FIGS. 7–9 show a combined converter-muffler in accordance with a further embodiment of the invention. This embodiment, besides utilizing muffler tubes, also utilizes a modified end construction which enables both the inlet and the outlet pipes to be located on a common horizontal axis. Other parts are the same or similar to those of the embodiment shown in FIGS. 1–5, and where possible reference numerals used in describing the embodiment of FIGS. 7–9 will be 100 greater than the reference numerals used for the same or similar parts of the embodiment of FIGS. 1–5.

The combined converter-muffler 110 shown in FIGS. 7–9 has a generally oval shaped housing 112 with end walls 114, 116, a centrally-located inlet pipe 118 secured to the end wall 114, and a centrally-located outlet pipe 120 secured to the end wall 116. An S-shaped catalyst support member 130 containing catalyst particles 114 and thermally expansive elements 160, 162 is slidably fitted in U-shaped channels 140, 142 secured to the inner side walls of housing 112.

The catalyst support member 130 abut baffles 111, 121 at opposite ends of the housing 112. The baffle 111 at the inlet end has an aperture 113, and an inlet muffler tube 115 extends within the housing 112 from one baffle to the other. The muffler tube 115 surrounds aperture 113 at one end, and its other end is closed by vessel 121. Inlet muffler tube 115 has a considerable number of shaped muffling apertures 117 in its wall, apertures 117 being spaced along the length of the tube 115 and around its circumference. As shown in FIG. 8, inlets muffler tube 115 is located in one of the undulations of the S-shaped catalyst support member 113.

Similarly, the baffle 121 at the outlet end had an aperture 123, and an outlet muffler tube 125 extends within the container from one raffle to the other. The muffler tube 125 surrounds aperture 123 at one end, and its other end is closed by vessel 111. Outlet muffler tube 125 has a considerable number of shaped muffling apertures 127 in its wall, the apertures 127 being spaced along the length of the tube 115 and around its circumference. As shown in FIG. 8, outlet muffler tube 125 is located in the other undulation of the S-shaped catalyst support member 130.

Exhaust gases enter the combined converter-muffler through the inlet pipe 118 and pass through the inlet vessel aperture 113 into the inlet muffler tube 115, from which the gases pass through the shaped muffling apertures 117 into the space above the catalyst support member 130. The gases then pass through the catalyst support member 130, thereby contacting the catalyst particles 114, into the space below the catalyst support member 130. The gases then pass into the outlet muffler tube 125 through the shaped muffling apertures 127, and from the muffler tube 125 through the outlet vessel aperture 123 and out through the outlet pipe 120.

In order to protect the housing 112, two metal shields 131, 133 are secured to the top and bottom respectively at the housing 112 and spaced in relationship therewith. The shields 131, 133 have apertures 135, 137 to assist cooling.

The compact nature and advantages of the invention will be clear from the foregoing description of preferred embodiments. Other embodiments will also be readily apparent to a person skilled in the art, the scope of the invention being defined in the appended claims.

What I claim as new and desire to protect by letters Patent of the United States is:

1. A catalytic converter comprising a housing, a gas pervious catalyst support member extanding across the housing and dividing the housing into an upper chamber and a lower chamber, said catalyst support member comprising two parallel spaced apart upper and lower foraminous sheets which undulate across the width of the container and which each has a single peak and a single trough to form a catalyst containing chamber between the two sheets having a generally sinusoidal-type wave configuration when viewed in cross-section along a plane perpendicular to the length of the housing, a bed of catalyst particles substantially filling the catalyst containing chamber, gas inlet means at one end of the housing positioned to cause gases to enter into one of the upper and lower chambers and pass through the catalyst support member and the catalyst containing chamber to the other of the upper and lower chambers, and gas outlet means at an opposite end of the housing and positioned to cause the gases to leave from the other chamber.

2. A catalytic converter according to claim 1, wherein the sinusoidal-type wave configuration has sufficient amplitude such that the peak in the lower foraminous sheet is higher than the trough in the upper foraminous sheet.

3. A catalytic converter according to claim 1, wherein the gas pervious catalyst support member is a replaceable enclosed unit which contains the catalyst particles.

4. A catalytic converter according to claim 3, including means to hold the catalyst support member within the housing comprising two U-shaped channels on opposite sides of the housing into which the catalyst support member slidably engages.

5. A catalytic converter according to claim 1, wherein the catalyst containing chamber also contains thermally expansive means to compensate for shrinkage of catalyst particles with increasing temperature.

6. A catalytic converter according to claim 5, wherein the thermally expansive means comprises vermiculite.

7. A catalytic converter according to claim 1, wherein the gas inlet and gas outlets means comprise pipes, and the height of the catalytic converter housing is approximately twice the diameter of the pipes.

8. A catalytic converter according to claim 7, wherein the height of the catalytic converter is about 4 inches.

9. A catalytic converter according to claim 1, wherein the two spaced apart foraminous sheets of the gas pervious catalyst support member have a sufficient sinusoidal configuration such that the volume of contained catalyst is at least 10% greater than if the two sheets were flat and spaced apart the same distance.

10. A catalytic converter according to claim 1, wherein the housing has at least one detachable end wall.

11. A catalytic converter according to claim 1, wherein the housing has an outwardly extending flange rim on an end of the housing and an end wall recessively mounted in the housing and extending out of the housing and bending around the outwardly extending flange rim.

12. A catalytic converter according to claim 1, wherein a muffler tube having shaped muffling apertures extends within the housing along one of the upper and lower chambers in an undulation of the catalyst support member, said muffler tube having its interior in communication with one of the gas inlet and outlet means to cause gases to pass through said shaped muffling apertures as well as through the catalyst support member during passage from the gas inlet means to the gas outlet means.

13. A catalytic converter according to claim 12, wherein said first mentioned muffler tube has its interior connected to the gas inlet means, and a second muffler tube having shaped muffling apertures extends within the housing along the other of the upper and lower chambers in an undulation of the catalyst support member, said muffler tube having its interior in communication with the gas outlet means to cause gases to pass through the shaped muffling apertures of the first muffler tube, then through the catalyst support member and then through the shaped muffling apertures of the second muffler tube during passage from the gas inlet means to the gas outlet means.

14. A catalytic converter according to claim 1, including inlet and outlet vessels extending across the interior of the housing adjacent said gas inlet and outlet means, said catalyst support member extending between said vessels, said gas inlet means comprising a centrally located inlet pipe in communication with an aperture in said inlet vessel and said gas outlet means comprising a centrally located outlet pipe in communication with an aperture in said outlet vessel.

* * * * *